US005129792A

United States Patent [19]

Abousabha

[11] Patent Number: 5,129,792

[45] Date of Patent: Jul. 14, 1992

[54] REFRIGERANT COMPRESSOR HAVING GAS PULSATION SUPPRESSION DEVICE

[75] Inventor: Naji G. Abousabha, Youngstown, N.Y.

[73] Assignee: General Motors Corporation, Detroit, Mich.

[21] Appl. No.: 645,776

[22] Filed: Jan. 25, 1991

[51] Int. Cl.[5] ..... F04B 39/00

[52] U.S. Cl. ..... 417/312; 181/277; 181/279; 181/403

[58] Field of Search ..... 181/244, 277, 279, 280, 181/264, 403; 417/312

[56] References Cited

U.S. PATENT DOCUMENTS

| | | | |
|---|---|---|---|
| 1,109,702 | 9/1914 | Reetz | 181/277 |
| 1,289,750 | 12/1918 | Hauman | 181/277 |
| 4,236,598 | 12/1980 | Wirt | 181/231 |
| 4,327,815 | 5/1982 | Hatturi | 181/277 X |
| 4,616,732 | 10/1986 | Carboni | 181/232 |
| 4,699,244 | 10/1987 | Bergquist et al. | 181/226 |
| 4,715,790 | 12/1987 | Iijima et al. | 417/312 |

FOREIGN PATENT DOCUMENTS

| | | | |
|---|---|---|---|
| 139414 | 9/1949 | Australia | 181/280 |
| 82842 | 1/1957 | Denmark | 181/403 |
| 130528 | 12/1928 | Switzerland | 181/277 |
| 293238 | 12/1953 | Switzerland | 181/277 |

*Primary Examiner*—Leonard E. Smith
*Attorney, Agent, or Firm*—Ronald L. Phillips

[57] ABSTRACT

A variable displacement wobble plate type refrigerant compressor includes a plurality of axially reciprocating pistons. A drive shaft rotates the wobble plate and thereby reciprocates the pistons within their respective compression chambers. Gaseous refrigerant is admitted to each compression chamber through a suction valve and discharged from each compression chamber through a discharge valve. Each discharge valve opens to a common discharge cavity. A hub is rotatable supported about a fixed axis within the discharged cavity, or downstream of the discharge cavity. A plurality of blades pivotally extend from the hub. A compression spring is disposed inside the hub for biasing the blades toward a flat condition. As discharged fluid moving through the discharge cavity impinges upon the blades, the blades are deflected to an angular, propeller-like, orientation for inducing rotation of the hub and thereby creating turbulence in the discharge fluid having a predominantly helical flow pattern downstream of the hub.

4 Claims, 4 Drawing Sheets

REFRIGERANT COMPRESSOR HAVING GAS PULSATION SUPPRESSION DEVICE

TECHNICAL FIELD

The subject invention relates to a refrigerant compressor having a discharge gas pulsation suppression device, and more particularly to a refrigerant compressor having a gas pulsation suppression device which creates a predominantly helical flow pattern in the discharged fluid.

BACKGROUND ART

An inherent characteristic of the refrigerant compressor, such as used in an automotive air conditioning system, is the generation of dynamic pressure fluctuations, or pulsations, due to the dynamics of the compression process and interaction of the gaseous refrigerant flow between the cylinders in the compressor. These pressure pulsations have the undesirable effect of exciting certain components in the automotive air conditioning system, as well as components in the vehicle structure, which result in objectionable noise and/or vibration. Also, the vibrating and rattling components are prone to rapid wear and premature failure.

The prior art has attempted to solve this problem by installing a pressure pulsation muffler in the discharge conduit extending from the compressor to the air conditioning condenser. However, the inline mounted mufflers are expensive and require considerable additional space. The prior art also teaches that pressure pulsations may be attenuated by enlarging the volume of the compressor discharqe plenum, or cavity, which, due to the expansion characteristics of refrigerant gas, will act to absorb some of the pressure pulsations. However, this prior art attempt to alleviate the pressure pulsation problem is also undesirable because an enlarged discharge cavity for the refrigerant compressor requires precious additional space and significantly increases the cost of the compressor.

Further, the prior art has attempted to alleviate the pressure pulsation problem by adding a gas flow restriction within the discharge cavity, as shown in the U.S. Pat. No. 4,715,790 to Iijima et al, issued Dec. 29, 1987. However, this method of gas pulsation suppression becomes particularly disadvantageous at high operating speeds, where the added pressure drop in the discharge cavity due to the orifice restriction significantly increases the discharge pressure within the discharge cavity, having the result of raising the pressures in the discharge cavity toward the critical limit of the surrounding materials, thereby significantly reducing the durability of the compressor.

SUMMARY OF THE INVENTION AND ADVANTAGES

A refrigeration compressor assembly of the type for compressing a recirculated refrigerant fluid includes a compression chamber having a low pressure fluid inlet and a high pressure fluid outlet, a piston reciprocally disposed in the compression chamber, and a discharge valve disposed adjacent the outlet for permitting one way fluid egress from the compression chamber through the outlet. The invention is characterized by including a turbulence generating means disposed downstream of the discharge valve for inducing turbulence into the discharged fluid having a predominantly helical flow pattern immediately downstream of the turbulence generating means to attenuate pressure pulsations in the discharged fluid.

The subject invention overcomes the deficiencies of the prior art gas pulsation suppressions devices by generating helically swirling turbulence into the discharged flow which has the inherent effect of attenuating pressure pulsations in the discharged fluid. Further, the turbulence generating means may be structured to create very little pressure drop thereacross during high speed operation whereby pressures in the discharge cavity are not increased above a limit where the structure integrity of the components will be placed in jeopardy. Hence, compressor durability will be maintained while pressure pulsations are attenuated.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENTS

Figure 1:
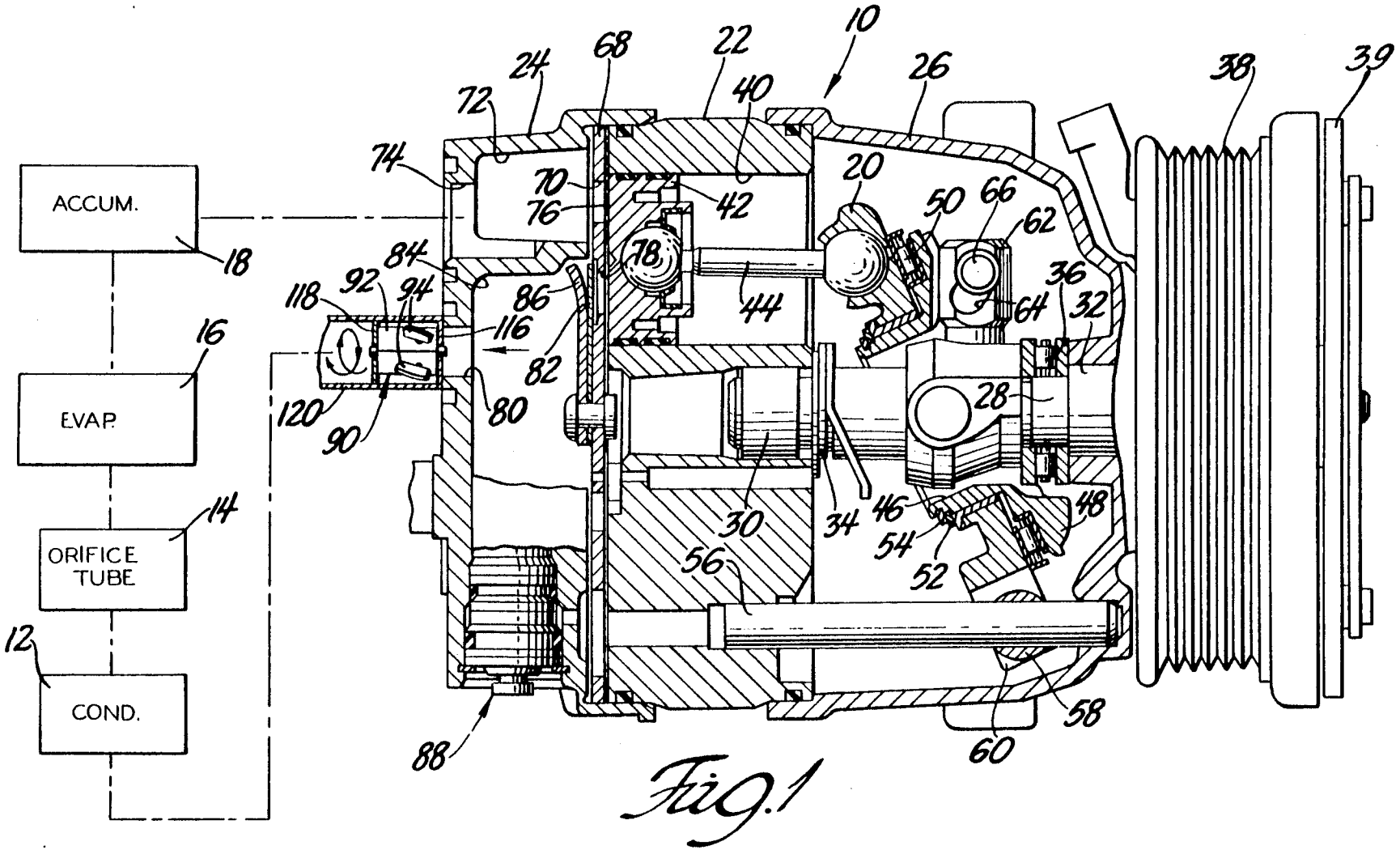
FIG. 1 is a cross-sectional view of a refrigerant compressor according to the subject invention including a schematic representation of an automotive air conditioning system in fluid communication with the suction inlet and discharge outlets of the refrigerant compressor.

Referring to the Figures, wherein like numerals indicate like or corresponding parts throughout the several views, an axial piston refrigerant compressor is generally shown at 10 in FIG. 1. The compressor 10 is of the type for compressing a recirculated refrigerant fluid in an automotive air conditioning system having the normal condenser 12 for condensing refrigerant gas into a liquid, orifice tube 14, evaporator 16 and accumulator 18 arranged in that order between the discharge and suction sides of the compressor 10.

The axial piston compressor 10 shown in FIG. 1 is preferably of the variable displacement type having a variable angle wobble plate 20. However, it will be appreciated that other piston/cylinder arrangements may be used, for example, a compressor having a plurality of radially extending pistons and cylinders would be equally applicable. The compressor 10 shown in FIG. 1 includes a cylinder block 22 having a head 24 and a crank case 26 sealingly clamped to opposite ends of the cylinder block 22. A drive shaft 28 is supported centrally within the cylinder block 22 and the crank case 26 by radial needle bearings 30, 32, respectively. The drive shaft 28 is axially retained in place by a thrust washer 34 adjacent the needle bearing 30, and a thrust bearing 36 adjacent the needle bearing 32. A pulley 38 is disposed on the end of the drive shaft 28 extending outwardly from the crank case 26 for operative connection to the automotive engine. An electromagnetic clutch 39 selectively engages and disengages the pulley 38 from the drive shaft 28.

The cylinder block 22 includes a plurality e.g., five, axial cylinders, or compression chambers 40, spaced in equal angular increments about the block 22, and equal radial distances from the axis of the drive shaft 28. A piston 42 is slidably disposed in each compression chamber 40. A piston rod 44 connects the back side of each piston 42 to the wobble plate 20. The piston rod 44 is pivotally retained at each end to the respective piston 42 and wobble plate 20 in known fashion.

The wobble plate 20 is of the non-rotary type and is mounted at its inner diameter on a journal 46 of a rotary drive plate 48. The wobble plate 20 is axially and rotatably retained on the journal 46 of the rotary drive plate 48 at one end by a thrust bearing 50, and at the other end by a thrust washer 52 and a snap ring 54. The drive plate 48 is pivotally and slidably connected at its journal 46 to the drive shaft 28 in known fashion to permit angular movement of the drive plate 48 and the wobble plate 20 relative to the drive shaft 28. The wobble plate 20 is fixed to the drive plate 48 in such a manner so as to allow angular movement of the wobble plate 20 with the drive plate 48 relative to the drive shaft 28, while allowing the wobble plate 20 to remain non-rotary. Accordingly, a guide pin 56 is press-fit on opposite ends thereof in the cylinder block 22 and in the crank case 26, parallel to the drive shaft 28. A ball guide 58 is slidably mounted on the guide pin 56 and retained on a fork extension 60 extending radially outwardly from the wobble plate 20.

A drive lug 62 extends radially outwardly from the drive shaft 28 for drivingly connecting the drive shaft 28 and the rotary drive plate 48. The drive lug 62 includes a guide slot 64 for guiding the angular movement of the drive plate 48 and the wobble plate 20 relative to the drive shaft 28. A cross pin 66 is slidably disposed within the slot 64 and retains an ear (not shown). The drive lug 62 arrangement for the drive plate 48 and the antirotation guide arrangement for the wobble plate 20 are like that disclosed in greater detail in U. S. Pat. No. 4,175,915 and 4,297,085, respectively assigned to the assignee of this invention, and which are hereby incorporated by reference.

A valve plate 68 is fixedly clamped between the head 24 and working end of the cylinder block 22. A suction inlet 70 is associated with each of the compression chambers 40 and generally comprises an opening through the valve plate 68. The head 24 is provided with a suction cavity, or chamber, 72 which is connected through an external port 74 to receive gaseous refrigerant from the accumulator 18, downstream of the evaporator 16. A suction valve 76 of the reed, or flapper, type is disposed over the suction inlet 70 for emitting fluid therefrom for flow to the compression chamber 40 as the piston 42 moves through its intake stroke.

Similarly, a discharge outlet 78 is provided as an opening through the valve plate 68 for each of the compression chambers 40. The discharge outlet 78 is connected through an external port 80 to expel compressed gaseous refrigerant from the compression chamber 40 to the condenser 12. A discharge valve 82 of the reed, or flapper, type is disposed over the discharge outlet 78 for discharging fluid from the compression chamber 40 to the condenser 12. The head 24 is provided with a discharge cavity 84 in fluid communication with each of the discharge outlets 78 of each of the compression chambers 40. A back-up strap 86 is disposed in the discharge cavity 84 adjacent each of the discharge valves 82 for limiting the extent of opening each of the discharge valves 82.

A variable displacement control valve arrangement, generally indicated at 88, is disposed in the head 24 and functions in response to discharge pressure within the discharge cavity 84 to control the angle of the wobble plate 20 relative to the axis of the drive shaft 28 in order to vary the displacement of each of the pistons 42 within their respective compression chambers 40. The variable displacement control valve 88 and associated structure is similar to that disclosed in greater detail in U.S. Pat. No. 4,428,718, assigned to the assignee of this invention, and which is hereby incorporated by reference.

According to the subject invention, a turbulence generating means, generally indicated at 90, is disposed in the flow of discharged gas, downstream of the discharge valves 82 for inducing turbulence into the discharged fluid. The induced turbulence, however, is characterized by having a predominantly helical flow pattern immediately downstream of the turbulence generating means 90 for attenuating the gas pressure pulsations in the discharged fluid. It has been found that by creating a swirling and spiraling flow of turbulent gas in the discharge flow, the dynamic pressure pulsations are significantly attenuated. The turbulence generating means 90 is supported for rotation in the flow about a fixed axis A, extending into, or parallel with, the flow of discharged gas. Therefore, the turbulence generating means 90 rotates about its axis A in response to an impinging flow of discharged fluid, and simultaneously creates a swirling, rotating flow pattern downstream thereof in order to attenuate the gas pressure pulsations in the discharged fluid.

Figure 7:
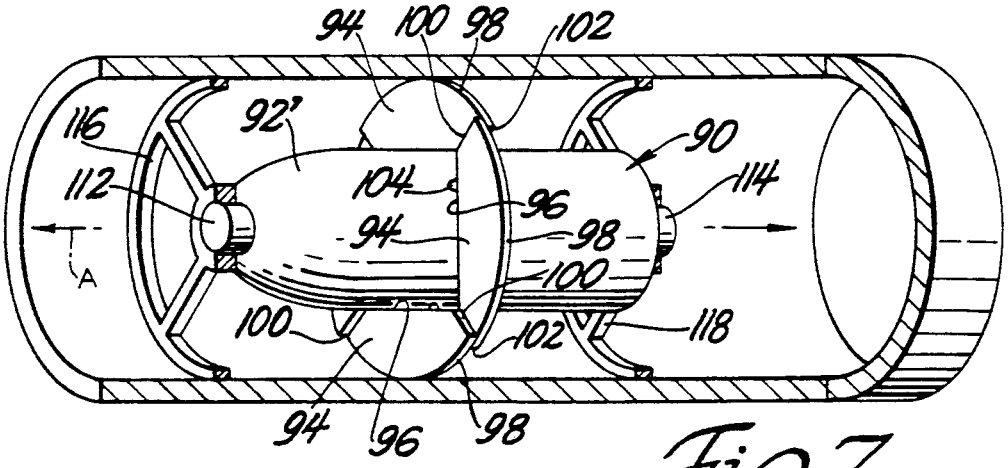
FIG. 7 is a perspective view of an alternative embodiment of the turbulence generating means disposed in a non-operational condition.
Figure 8:
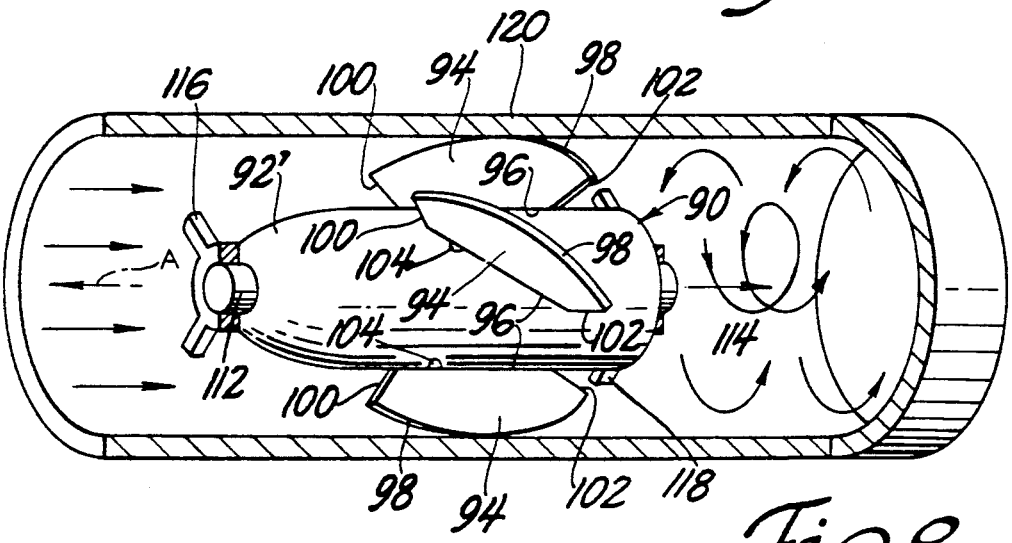
FIG. 8 is a perspective view of the alternative embodiment of the turbulence generating means disposed in an operational condition.

The turbulence generating means 90 includes a hub 92 comprising a hollow box-shaped member, as shown in FIGS. 2 through 5. In FIGS. 7 and 8 an alternative shaped hub 92' is shown having a more aerodynamic bullet, or torpedo, shape.

The turbulence generating means 90 further includes a plurality of sheet-like blades 94 which rotate with the hub 92 about the fixed axis A to describe a helical path as they rotate about the fixed axis A. Therefore, the hub 92 and blades 94 take the general appearance of a screw propeller and thereby induce a helical flow pattern in the downstream gas during rotation. As shown in the Figures, four such blades 94 are provided, each having a generally truncated sector shape. Even for the alternative embodiment shape of the hub 92' shown in FIGS. 7 and 8, the blades 92 retain their generally truncated sector shape. That is, each of the blades 94 include a straight inner edge 96 and a segmented circular, or arc-shaped, outer edge 98. Further, the blades 94 include a leading edge 100 and a trailing edge 102 each extending radially from the fixed axis A. The leading edge 100 of each blade 94 overlaps the trailing edge 102 of the next adjacent blade 94.

Figure 4:
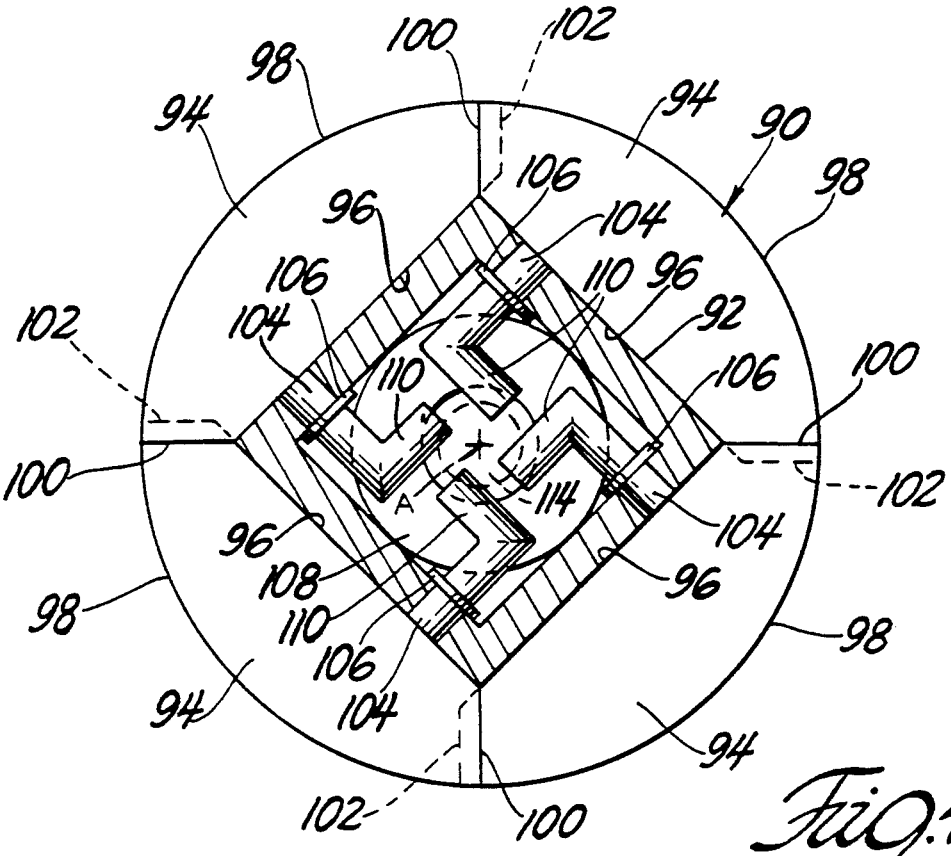
FIG. 4 is a cross-sectional view of the turbulence generating means taken along lines 4—4 of FIG. 2.
Figure 5:
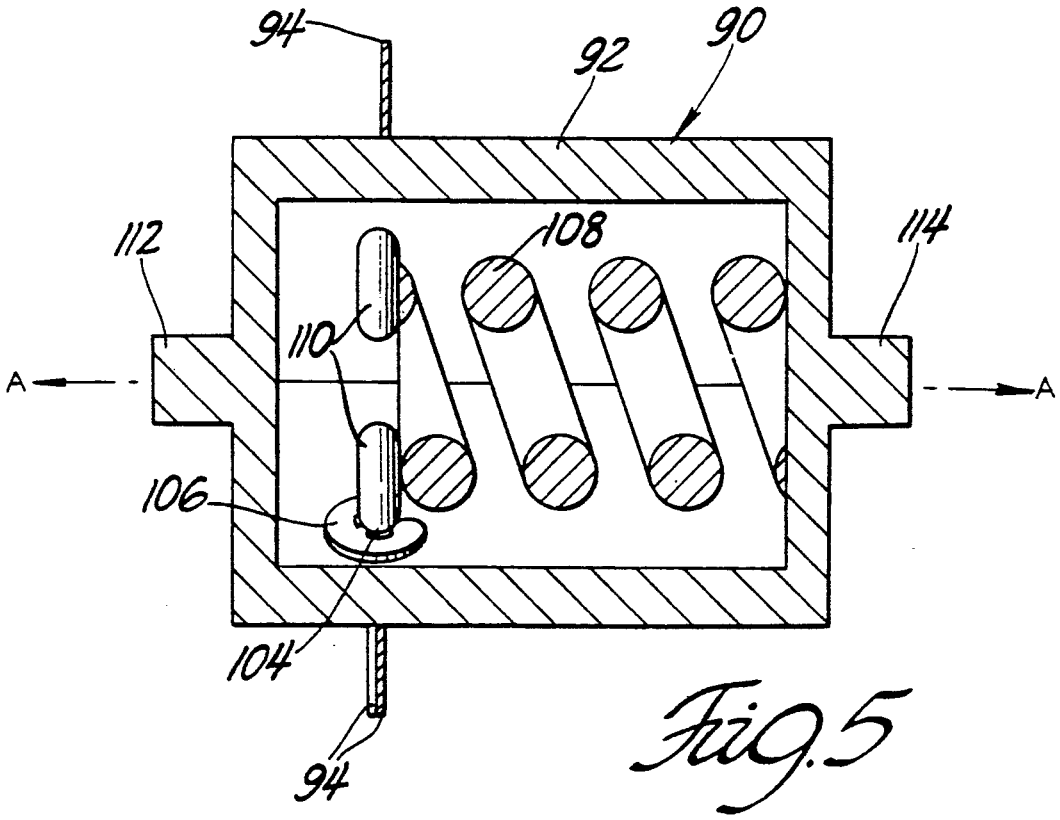
FIG. 5 is a cross-sectional view of the turbulence generating means taken along lines 5—5 of FIG. 3.
Figure 6:
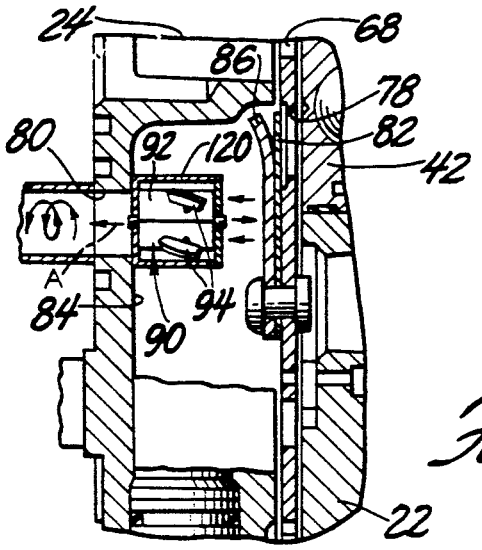
FIG. 6 is a fragmentary view of the turbulence generating means disposed inside the discharge cavity of a refrigerant compressor.

As perhaps best shown in FIG. 4, each of the blades 94 are supported in the hub 92 by a cylindrical hinge 104. That is, the side walls of the hollow hub 92 pivotally support each hinge 104 to allow pivotal movement of each of the blades 94 relative to the hub 92. A retaining clip 106 is disposed over each hinge 104 on the inner side of the hub 92 wall, for preventing axial movement of the hinge 104 while permitting rotative movement. The hinge 104 is disposed proximate the respective leading edge 100 of each blade 94. That is, each hinge 104 is fixedly attached to the inner edge 96 of each blade 94 at a position much closer to the leading edge 100 than to the trailing edge 102. Therefore, when gas pressure contacts the blades 94, a bending moment will be created upon each blade 94 about its hinge 104, causing each blade 92 to rotate on its hinge 104 with the leading edge 100 being forced into the flow of gas and the trailing edge 102 being forced away from the flow of gas in much the same way as a weather vane.

Figure 2:
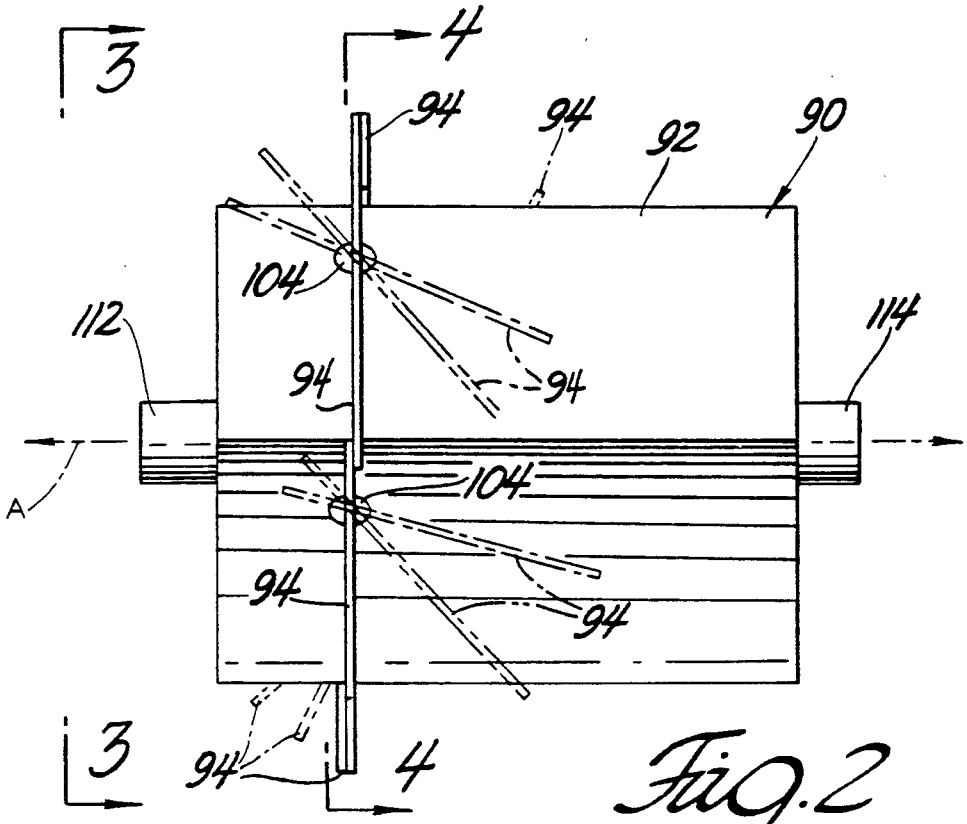
FIG. 2 is a side elevational view of the turbulence generating means of the subject invention.
Figure 3:
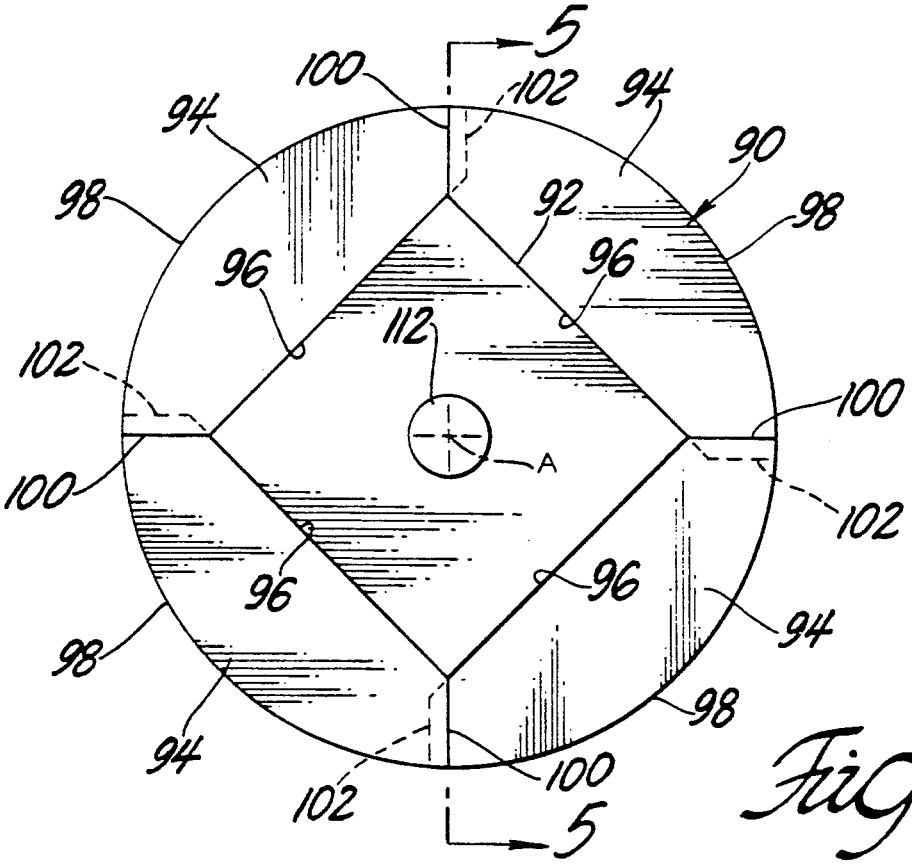
FIG. 3 is an end view of the turbulence generating means taken along lines 3—3 of FIG. 2.

A biasing means 108 is disposed inside the hub 92, 92' for urging the blades 94 toward a maximum angle relative to the fixed axis A. The maximum angle is best shown in FIGS. 2 and 7 wherein the blades 94 are disposed generally perpendicular to the fixed axis A. The biasing means 108 generally comprises a compression spring disposed concentrically about the fixed axis A.

Each of the blade hinges 104 terminate in an L-shaped end piece lever 110 inside the hub 92, 92', as shown in FIG. 4. Each of the L-shaped levers 110 are disposed in a plane parallel to the respective planes of the sheet-like blades 94 and perpendicular to the fixed axis A. Therefore, as the blades 94 are rotated about the respective hinges 104, the levers 110 are rotated against the biasing means 108. Although not shown in FIGS. 7 and 8, the alternative shaped hub 92' includes similar blade levers 110 and a biasing means 108 so that its operation is identical to that as described above.

The hub 92, 92' includes a forward pintle 112 and a rearward pintle 114 extending from each end of the hub 92, along the fixed axis A, as shown in FIG. 2. A forward spoke-like support structure 116 and a rearward spoke-like support structure 118 are provided for rotatably supporting the forward 112 and rearward 114 pintles, respectively, as shown in FIGS. 7 & 8. Each of the support structures 116, 118 include radially extending support braces, or spokes, which permit the flow of gas through the respective support structures 116, 118 with minimal disturbance.

As shown in FIGS. 1, 6, 7 and 8, a tubular shroud 120 surrounds the turbulence generating means 90. The internal diameter of the shroud 120 is such that a minimal clearance is provided between the outer edges 98 of each of the blades 94. In FIG. 1, the shroud 120 is illustrated as comprising an integral portion of the gas flow conduit extending between the external port 80 and the air conditioning condenser 12. However, in FIG. 6 the tubular shroud 120 is illustrated as a separate member disposed inside the discharge cavity 84.

In operation, and referring to FIGS. 7 and 8, the turbulence generating means 90 functions to attenuate dynamic pressure pulsation in the discharged fluid by creating a swirling, spiral flow in the fluid downstream of the turbulence generating means 90. As shown in FIG. 7, the biasing means 108 urges the blades 94 toward a maximum angle position with respect to the fixed axis A, wherein the four blades 94 nearly resemble a thin annular disc surrounding the hub 92'. When discharged gas flow impinges upon the blades 94, as represented by the arrows in FIG. 8, the blades 94 are rotated about their respective hinges 104 to an angular position proportional with respect to the dynamic pressure in the gas flow. In this position, the blades 94 resemble a screw propeller and induce rotation in the hub 92'.

Such rotation of the hub 92' along with the rotating blades 94 create a helical swirling flow pattern in the gas immediately downstream of the turbulence generating means 90. This swirling, spiral flow effectively reduces, or attenuates, the dynamic pressure pulsations in the gas flow by absorbing the pulsating pressure shock waves. It will be appreciated that the higher the pressure in the discharged fluid, the greater deflection will be imparted to each of the blades 94, such that the restriction to fluid flow through the shroud 120 will be decreased as the fluid pressure increases. For example, in FIG. 2 the blades 94 are shown in phantom in a partially rotated position representative of a medium pressure flow. A fully rotated position of the blades 94 is also shown in phantom and is representative of a high pressure flow. Therefore, at high operating pressures of the compressor 10, the restriction to fluid flow is decreased to alleviate the problems existing in the prior art wherein the structural integrity of the surrounding components is placed in jeopardy at such high pressures.

The pressure drop across the turbulence generating means 90 can be adjusted to an optimum level by substituting another biasing means 108 having a different spring constant, i.e., a different stiffness. In this manner, the turbulence generating characteristics, and hence the pulsation attenuating characteristics, can be optimized for a particular application.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A refrigeration compressor assembly of the type for compressing a recirculated refrigerant fluid, said assembly comprising: a compression chamber having a low pressure fluid inlet and a high pressure fluid outlet; a piston reciprocally disposed in said compression chamber; a discharge valve disposed adjacent said outlet for permitting one-way fluid egress form said compression chamber through said outlet; and characterized by turbulence generating means disposed downstream of said discharge valve for inducing turbulence into the discharged fluid having a predominately helical flow pattern immediately downstream of said turbulence generating means to attenuate pressure pulsations in the discharged stream; said turbulence generating means including blades inclined at an angle with respect to axial flow from said discharge valve and means for varying the angle of said blades in accordance with the discharge pressure at said discharge valve for decreasing the restriction to fluid flow as the operating pressure increases at the discharge valve.

2. A refrigeration compressor assembly of the type for compressing a recirculated refrigerant fluid, said assembly comprising: a compression chamber having a low pressure fluid inlet and a high pressure fluid outlet; a piston reciprocally disposed in said compression chamber; a discharge valve disposed adjacent said outlet for permitting one-way fluid egress from said compression chamber through said outlet; and characterized by rotary turbulence generating means disposed downstream of said discharge valve for inducing turbulence into the discharged fluid having a predominately helical flow pattern immediately downstream of said rotary turbulence generating means to attenuate pressure pulsations in the discharged stream; said rotary turbulence generating means including a rotating hub and blades supported on said rotating hub for pivotal movement with respect to said rotating hub; said blades inclined at an angle with respect to axial flow from said discharge valve and means for varying the angle of said blades in accordance with the discharge pressure at said discharge valve for decreasing the restriction to fluid flow as the operating pressure increases at the discharge valve.

3. A multi-piston refrigeration compressor assembly of the type for compressing a recirculated refrigerant fluid, said assembly comprising: a plurality of compression chambers each having a low pressure fluid inlet and a high pressure fluid outlet; a piston reciprocally disposed in each of said compression chambers; a discharge valve disposed adjacent each of said outlets for permitting one-way fluid egress from each of said compression chambers through said outlet; and characterized by including a hub rotatably supported about a fixed axis downstream of said discharge valves, and a plurality of blades pivotally extending from said hub for inducing rotation of said hub in response to an impinging flow of discharged fluid to create turbulence in the discharged fluid and thereby attenuate pressure pulsations in the discharged fluid.

4. A multi-piston refrigeration compressor assembly of the type for compressing a recirculated refrigerant fluid, said assembly comprising: a plurality of compression chambers each having a low pressure fluid inlet and a high pressure fluid outlet; a piston reciprocally disposed in each of said compression chambers; a discharge valve disposed adjacent each of said outlets for permitting one-way fluid egress from each of said compression chambers through said outlet; and characterized by including a hub rotatably supported about a fixed axis downstream of said discharge valves, a plurality of blades pivotally extending from said hub for inducing rotation of said hub in response to an impinging flow of discharged fluid, and biasing means disposed in said hub for urging said blades to a maximum angle relative to said axis to create turbulence in the discharged fluid and thereby attenuate pressure pulsations in the discharged fluid.

* * * * *